United States Patent [19]

Martinmaas

[11] 4,352,306

[45] Oct. 5, 1982

[54] SOCKET WRENCH WITH INTERCHANGEABLE SOCKETS STORED IN HANDLE

[76] Inventor: Werner W. Martinmaas, 3461 Cashill Blvd., Reno, Nev. 89509

[21] Appl. No.: 284,952

[22] Filed: Jul. 20, 1981

[51] Int. Cl.[3] ..... B25G 1/08

[52] U.S. Cl. ..... 81/177 N; 145/62; 206/378

[58] Field of Search ..... 16/110.5; 81/177 R, 81/177 E, 177 G, 177 M, 177 N, 180 R; 145/61 R, 61 J, 62; 206/375, 378, 559, 560; 220/20, 22

[56] References Cited

U.S. PATENT DOCUMENTS

| | | | |
|---|---|---|---|
| 1,289,558 | 12/1918 | Sedgley | 81/177 N X |
| 1,680,578 | 8/1928 | Wakefield | 206/375 |
| 1,724,491 | 8/1929 | Mandl | 81/177 G X |
| 1,961,450 | 6/1934 | Petersen | 206/375 |
| 2,301,945 | 11/1942 | Green | 81/124.1 |
| 2,776,589 | 1/1957 | Gregory | 81/177 N |
| 3,745,860 | 7/1973 | Bennett | 81/177 N X |
| 4,253,356 | 3/1981 | Martinmaas | 145/62 |

FOREIGN PATENT DOCUMENTS

| | | | |
|---|---|---|---|
| 1504865 | 3/1978 | United Kingdom | 145/62 |

*Primary Examiner*—James G. Smith
*Attorney, Agent, or Firm*—Wegner, McCord, Wood & Dalton

[57] ABSTRACT

Socket member storage means for a set of interchangeable sockets of a socket wrench has a longitudinal wall defining a long, narrow storage cavity which has an entrance opening along one side and which is divided into several distinct portions, each of which receives one socket member of a set. A separate retaining strap on each portion of the storage cavity has one end hinged on one side of the wall and has a fastener on the other end detachably connecting it to the other side of the wall to snugly embrace and retain one socket member in the storage cavity. Detachment of the fastening means of one strap permits removal of the one socket member from the storage cavity independently of any other socket member. Preferably, the longitudinal wall provides the handle of the wrench.

10 Claims, 3 Drawing Figures

34
24
16
11
10
9
35
36
25
2.
37
26
23
38
27
39
28
40
29
41
30
33
31
15
8
14
32
23
21
20
19
18
2.
17

46
44
47
34
35
25
3.
44
13
12
42
45
43
11
48
49
10
3.

35
25
44
47
11
45
46
48
10

SOCKET WRENCH WITH INTERCHANGEABLE SOCKETS STORED IN HANDLE

BACKGROUND OF THE INVENTION

Applicant's U.S. Pat. No. 4,253,356 discloses a socket wrench structure which includes socket member storage means of the same general type disclosed in the present application.

For reasons stated in the specification of U.S. Pat. No. 4,253,356, the type of socket wrench there disclosed reduces the possibility that sockets will be misplaced, and eliminates the problem of getting into a job in which a socket wrench is required and then discovering the sockets needed for the job are not at hand.

SUMMARY OF THE INVENTION

The principal object of the present invention is to provide a socket storage means of the general type disclosed in U.S. Pat. No. 4,253,356, but in which the access openings of that device are eliminated.

In accordance with the present invention, socket member storage means comprises a longitudinal wall defining a long, narrow storage cavity which has an entrance opening along one side, and the storage cavity has several distinct portions along its length, each of which receives one socket member of a set. A separate retaining strap on each portion of the storage cavity has one end hinged on one side of the wall and has fastening means on the other end detachably connecting it to the other side of the wall to snugly embrace and retain one socket member in the storage cavity. Detachment of one strap connecting means from the wall permits removal of a single socket member from the storage cavity independently of any other socket member.

THE DRAWINGS

DETAILED DESCRIPTION OF THE INVENTION

Figure 1:
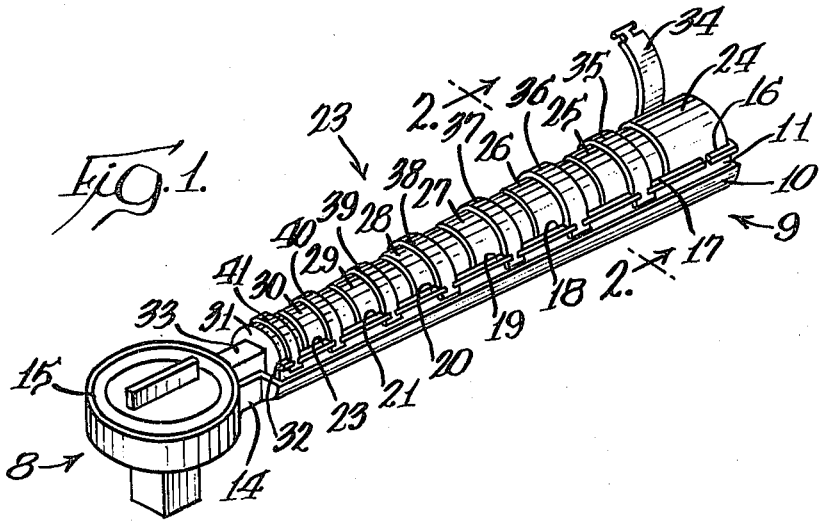
FIG. 1 is a perspective view of a socket wrench embodying the present invention.

Referring to the drawings in detail, a socket wrench, indicated generally at 8, includes a composite longitudinal wall 9 consisting of a metal shell 10 and a plastic liner 11 which are bonded together to define a long, narrow storage cavity 12, one side of which is open to provice an entrance opening 13. In the disclosed embodiment, the shell 10 is integrally connected by a neck 14 with a wrench head 15 so as to provide a handle for the wrench. The storage cavity has several distinct portions along its length, numbered 16 through 22; and a set of socket members, indicated generally at 23, has its individual socket members 24 through 30, stored, respectively, in the storage cavity portions 16 through 22. An extension member 31 is also received in a forwardmost portion 32 of the storage cavity and has a stub 33 that seats in the neck 14 of the wrench.

Each of the distinct socket portions 16 through 22 and 32 is provided with a retaining strap, and said straps are numbered, respectively, 34 through 41. Except for length, all of the retaining straps are identical, so only the straps 34 and 35 will be described in detail with reference to FIGS. 2 and 3.

Figure 2:
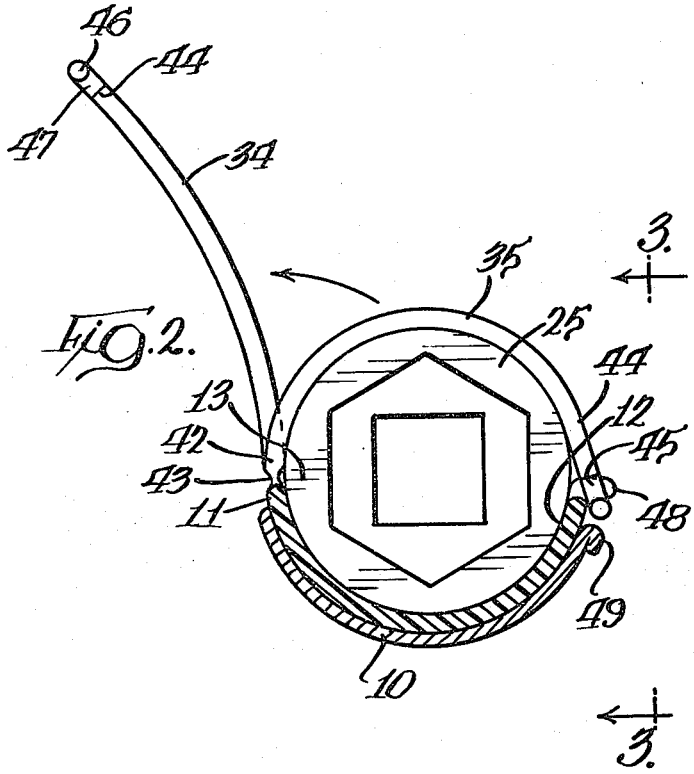
FIG. 2 is a transverse sectional view on an enlarged scale taken substantially as indicated along the line 2—2 of FIG. 1.
Figure 3:
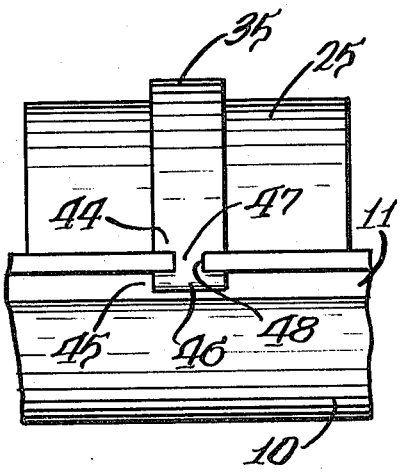
FIG. 3 is a fragmentary side elevational view of a part of FIG. 2 taken as shown along the line 3—3 of FIG. 2.

The retaining strap 35 as seen in FIG. 2 to be formed integrally with the plastic liner 11 and to have a first end 42 connected to the liner by a portion of reduced thickness that forms a hinge 43. The other end 44 of the retaining strap 35 has fastening means 45 detachably connecting it to the liner 11 opposite the hinge 43. As best seen in FIG. 3, the fastening means 45 consists of a first part in the form of a tab 46 which is connected to the retaining strap 35 by a narrow neck 47, and a second part in the form of a slot 48 in the liner 11 which is slightly wider than the neck 47 and narrower than the tab 46. The material of the liner 11 and the straps is sufficiently flexible that the retaining tab 46 may be readily manipulated to release it from the liner slot 48.

Each of the retaining straps is of a length to snugly embrace the socket member in the portion of the storage cavity with which it is associated when its fastening means is connected to the liner 11 of the wall 9. When a strap is detached as illustrated by the strap 34 in the drawings, the socket member normally embraced by the strap may be removed from the storage cavity 12 independently of any of the other socket members.

As best seen in FIG. 2, the metal shell 10 has a laterally projecting, rounded longitudinal rib 49 beneath the detachable fastening means 45.

The foregoing detailed description is given for clearness of understanding only and no unnecessay limitations should be understood therefrom, as modifications will be obvious to those skilled in the art.

I claim:

1. Socket member storage means for a set of interchangeable sockets of a socket wrench of the type which has a head with a socket mounting stub, said storage means comprising:

a longitudinal wall defining a long, narrow storage cavity which has an entrance opening along one side, said storage cavity having several distinct portions along its length each of which receives one socket member of a set;

a separate retaining strap operatively associated with each such portion;

a hinge connecting a first end of each retaining strap to the wall at one side of the portion with which it is associated;

and fastening means detachably connecting the other end of each retaining strap to the wall opposite said hinge, each of said retaining straps being of a length to snugly embrace the socket member in said portion when its fastening means is connected to the wall, whereby detachment of one strap connecting means from the wall permits removal of a single socket member from the storage cavity independently of any other socket member.

2. The storage means of claim 1 which includes a liner of plastic material integrally connected with and forming the inner part of the wall, in which the hinges and the retaining straps are formed integrally with said liner, and in which each fastening means comprises a first part integral with the strap and a second part integral with said liner.

3. The storage means of claim 2 in which each fastening means first part is a tab connected to the retaining strap by a narrow neck, and each fastening means second part is a slot in the liner which is slightly wider than the neck and narrower than the tab.

4. The storage means of any of the preceding claims in which the longitudinal wall is integrally connected to the head and provides a handle for the wrench.

5. Socket member storage means for a set of interchangeable sockets of a socket wrench of the type which has a head with a socket mounting stub, said storage means comprising:

a longitudinal wall defining a long, narrow storage cavity, said wall having spaced margins defining an entrance opening along one side of the cavity, and said storage cavity having several portions along its length each of which receives one socket member of a set;

retaining means operatively associated with said portions;

hinge means connecting said retaining means to one margin in the wall;

and fastening means detachably connecting said retaining means to the opposite margin of the wall, so that when said fastening means is connected to said opposite margin the retaining means confines each socket member in one of said portions of the storage cavity, and detachment of said fastening means from said opposite margin of the wall permits removal of a single socket member from the storage cavity independently of any other socket member.

6. The storage means of claim 5 which includes a liner of plastic material integrally connected with and forming a part of the wall, in which the hinge means and the retaining means are formed integrally with said liner, and in which the fastening means comprises a first part integral with the retaining means and a second part integral with said liner.

7. The storage means of claim 6 in which the retaining means comprises a separate retaining member operatively associated with each portion of the storage cavity, the hinge means comprises a separate hinge on each retaining member, and the fastening means comprises a separate fastening member detachably connecting each retaining member to the opposite margin of the wall.

8. The storage means of claim 7 in which each fastening means first part is a tab connected to the flexible retaining member by a narrow neck, and each fastening means second part is a slot in the liner which is slightly wider than the neck and narrower than the tab.

9. The storage means of claim 1 in which the retaining means comprises a separate retaining member operatively associated with each portion of the storage cavity, the hinge means comprises a separate hinge on each retaining member, and the fastening means comprises a separate fastening member detachably connecting each retaining member to the opposite margin of the wall.

10. The storage means of any of claims 5 to 9 in which the longitudinal wall is integrally connected to the head and provides a handle for the wrench.

* * * * *